US006302735B1

(12) United States Patent
Nishide et al.

(10) Patent No.: US 6,302,735 B1
(45) Date of Patent: Oct. 16, 2001

(54) CONNECTOR WITH RETAINER TO PREVENT EXCESSIVE DEFORMATION OF TWO ELASTICALLY DEFORMABLE LOCKING PORTIONS

(75) Inventors: Satoru Nishide; Hajime Kawase; Ryotaro Ishikawa, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/357,080

(22) Filed: Jul. 20, 1999

(30) Foreign Application Priority Data

Aug. 7, 1998 (JP) ..... 10-224780

(51) Int. Cl.[7] ..... H01R 13/40

(52) U.S. Cl. ..... 439/595; 439/592; 439/603; 439/752

(58) Field of Search ..... 439/595, 592, 439/603, 752

(56) References Cited

U.S. PATENT DOCUMENTS

| | | | | |
|---|---|---|---|---|
| 5,151,052 | * | 9/1992 | McCardell | 439/598 |
| 5,746,624 | * | 5/1998 | Oshumi et al. | 439/595 |
| 5,928,034 | | 7/1999 | Tabata et al. . | |
| 6,165,011 | * | 12/2000 | Fukuda | 439/595 |

FOREIGN PATENT DOCUMENTS 0 420 010 3/1991 (EP) .

63-37085 3/1988 (JP) .

* cited by examiner

*Primary Examiner*—Paula Bradley
*Assistant Examiner*—Truc Nguyen
(74) *Attorney, Agent, or Firm*—Anthony J. Casella; Gerald E. Hespos

(57) ABSTRACT

A connector housing is provided to prevent a locking portion from being excessively deformed when the insufficient insertion of a terminal fitting is detected. Cavities 3 are provided in two stages in the connector housing, and locking portions 11 are arranged back to back to share deformation permitting spaces 16. The upper and lower locking portions 11 are arranged such that the longitudinal axes thereof are transversely offset to each other. Detecting portions 23 to be inserted into the deformation permitting spaces 16 project from a retainer 20. At the left and right ends of an inserting end surface 24 of each detecting portion 23, excessive deformation preventing portions 25 are formed symmetrically with respect to vertical direction. The excessive deformation preventing portions 25 can individually come into contact with leading ends 13 of the upper and lower locking portions 11. If a female terminal fitting 8 is insufficiently inserted as in the upper stage of FIG. 7, the retainer 20 may further deform the locking portion 11 after coming into contact therewith, while being inserted. However, the excessive elastic deformation of the locking portion 11 is restricted by the leading end 13 thereof being brought into contact with the excessive deformation preventing portion 25 at the lower side.

11 Claims, 10 Drawing Sheets

CONNECTOR WITH RETAINER TO PREVENT EXCESSIVE DEFORMATION OF TWO ELASTICALLY DEFORMABLE LOCKING PORTIONS

BACKGROUND OF THE INVENTION

1. Field of the Invention

The present invention relates to a connector provided with a retainer.

2. Description of the Related Art

A prior art connector provided with a front type retainer is disclosed in Japanese Utility Model Publication No. 63-37085. This prior art connector also is shown in FIG. 10, and is constructed such that cavities b are provided in two stages in a housing and locking portions c are formed back to back in the respective cavities b. Terminal fittings d are inserted into the cavities b from behind, and are pushed in while deforming the locking portions c into a common deformation permitting space e as shown in the upper stage of FIG. 10. When the terminal fittings d are inserted to their proper insertion positions, they are locked so as not to come out of the cavities b by the locking portions c which have been restored to their original shape and have been fitted into locking holes f.

There is also provided a retainer g to be inserted into the deformation permitting space e from front. If the terminal fittings d are properly inserted, the retainer g is inserted into the deformation permitting space e to prevent the elastic deformation of the locking portions c, thereby doubly locking the terminal fittings d. On the other hand, if the terminal fitting d is left insufficiently inserted as shown in the upper stage, any further insertion of the retainer g is prevented due to the contact with the locking portion c projecting into the deformation permitting space e. In this way, the insufficient insertion of the terminal fitting d can be detected.

The prior art construction will properly detect an incomplete insertion of the terminal d if the retainer g is inserted slowly. However, a retainer g that is forcibly pushed may deform the locking portion c to a large extent after coming into contact with the leading end thereof. Then, the locking portion c may be damaged or broken at its base portion or the like, and may permit the complete insertion of the retainer g even though the terminal fitting d has been insufficiently inserted. Thus the forcibly inserted retainer "a" can provide a false indication of a completely inserted terminal fitting "d"

The present invention was developed in view of the above problem, and an object thereof is to prevent a damage of a locking portion when the insufficient insertion of a terminal fitting is detected.

SUMMARY OF THE INVENTION

According to the invention, there is provided a connector, comprising one or more cavities into which one or more terminal fittings are to be inserted (at least partially). The cavities are provided with elastically deformable locking portions, and each locking portion permits the insertion of the corresponding terminal fitting by elastically deforming to project into a deformation permitting space. The locking portion then is restored to a position substantially not projecting into the deformation permitting space, and preferably substantially to its original shape, when the terminal fitting is inserted to its proper insertion position, thereby locking the terminal fitting. A retainer is insertable into the deformation permitting space and substantially comes into contact with the locking portion that was deformed elastically to project into the deformation permitting space if the terminal fitting is left insufficiently inserted. Thus the retainer enables a detection of the insufficient insertion of the terminal fitting. The retainer comprises an excessive deformation preventing portion for restricting an excessive elastic deformation of the locking portion by coming substantially into contact with a contact part, preferably a leading or deformable end of the locking portion when the retainer comes into contact with the elastically deformed locking portions According to the invention, damage of the locking portion can be prevented by preventing an excessive elastic and/or non elastic deformation thereof.

When the locking portion is elastically deformed to project into the deformation permitting space, the retainer comes into contact with the locking portion while being inserted into the deformation permitting space. If the retainer is particularly strongly inserted, it may further elastically deform the locking portion. However, the deformable end of the locking portion is brought into contact with the excessive deformation preventing portion provided on the retainer, thereby preventing the locking portion from being excessively elastically deformed. This prevents the locking portion from being damaged and/or broken, and the insufficient insertion of the terminal fitting can be detected with accuracy.

According to a preferred embodiment of the invention, the locking portions of the plurality of cavities are arranged substantially back to back so that a pair of the corresponding locking portions can be deformed elastically to project into the common deformation permitting space. Additionally the longitudinal axes of the pair of the locking portions may be offset to each other, and the retainer may be provided with the excessive deformation preventing portions in positions corresponding to the respective locking portions.

The excessive deformation of the locking portion during an insufficient insertion detection can be prevented even in connectors of the type in which deformation permitting spaces are shared by two locking portions by arranging locking portions back to back in order to make the connector smaller.

Preferably, one or more wall forming portions are formed on the retainer. Each wall forming portion forms a cavity wall, and preferably a bottom or ceiling wall of the respective cavity. The cavity walls preferably are in front of the corresponding locking portion when the retainer is inserted to its proper insertion position.

According to a further preferred embodiment, the substantially middle of an inserting end of each detecting portion with respect to a widthwise direction thereof is retracted from opposing ends to form a recess.

Preferably, the recess is formed such that the inserting end surface substantially has a triangular cross section.

These and other objects, features and advantages of the present invention will become more apparent upon a reading of the following detailed description and accompanying drawings.

DETAILED DESCRIPTION OF THE PREFERRED EMBODIMENT

Figure 1:
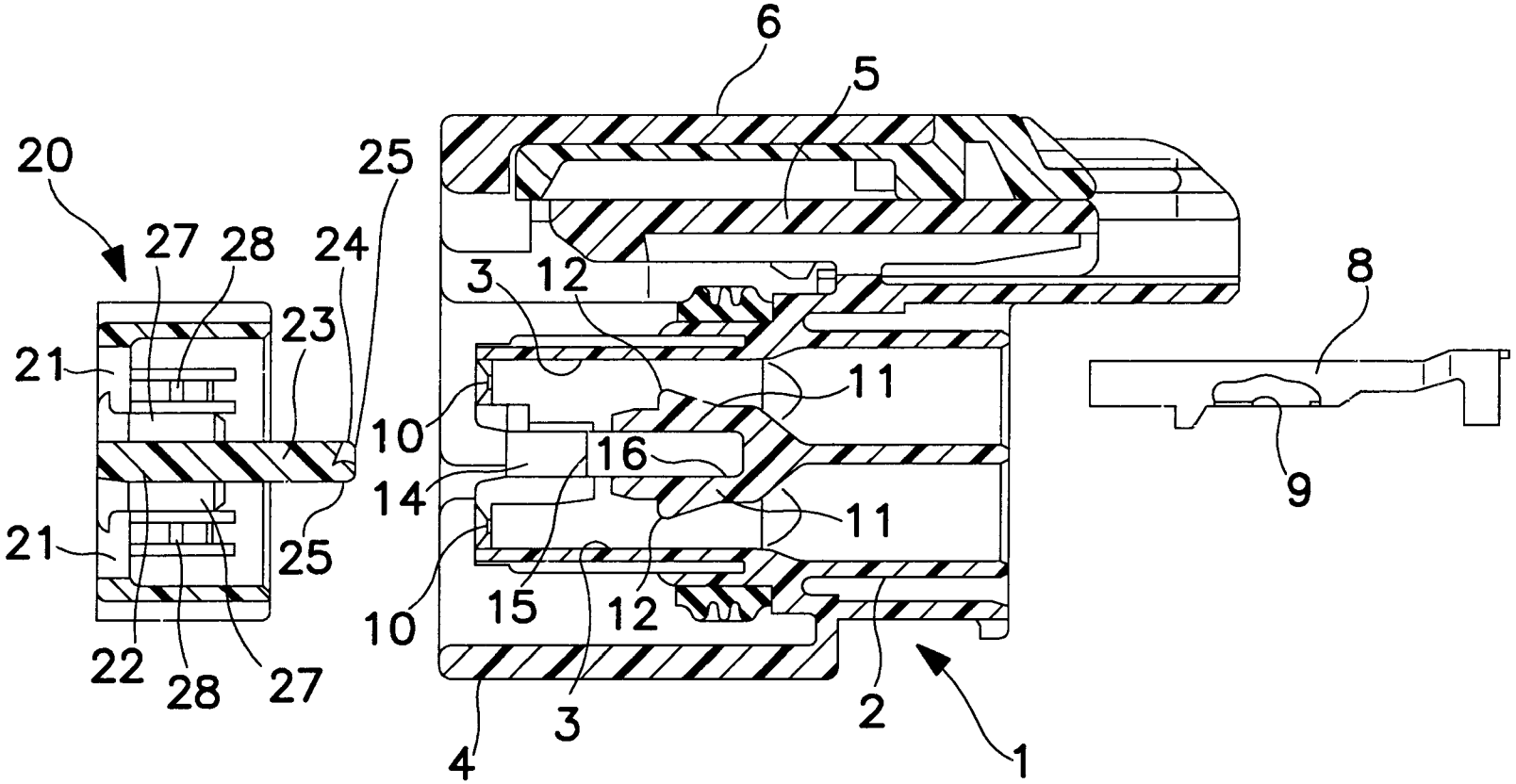
FIG. 1 is a vertical section of a connector before female terminal fittings and a retainer are mounted.
Figure 2:
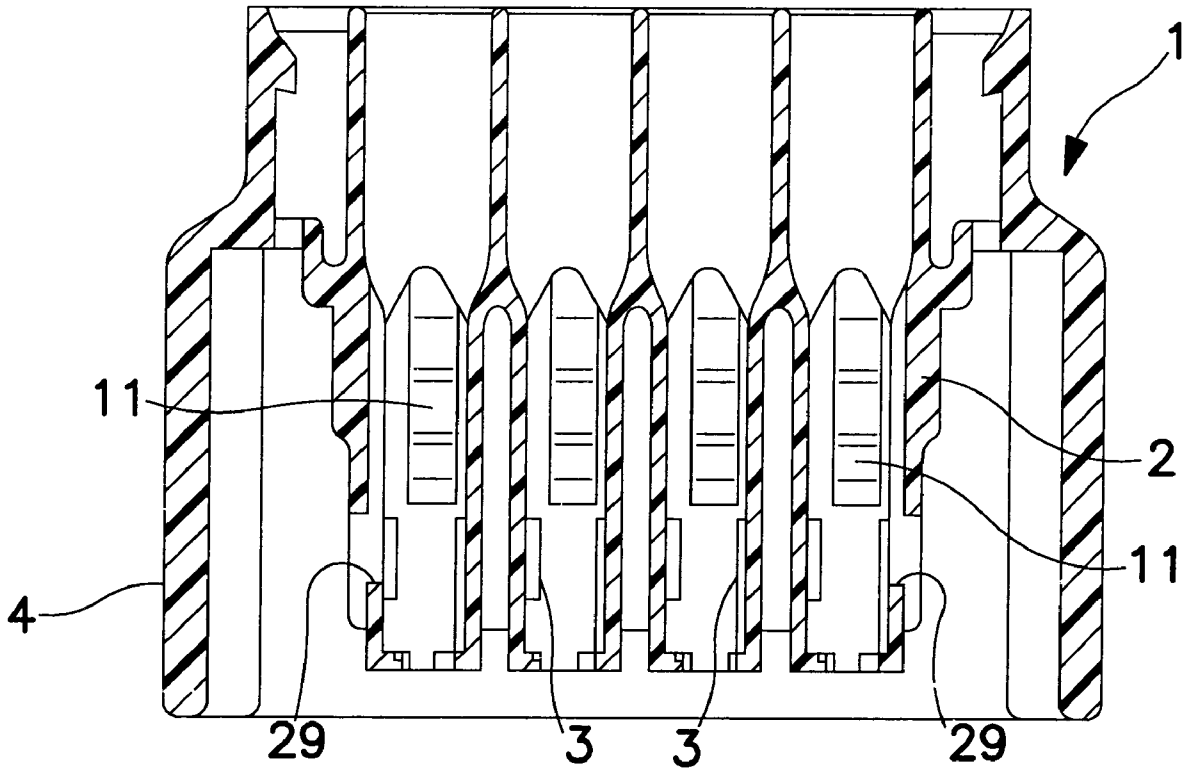
FIG. 2 is a plan view in section of a female housing.
Figure 3:
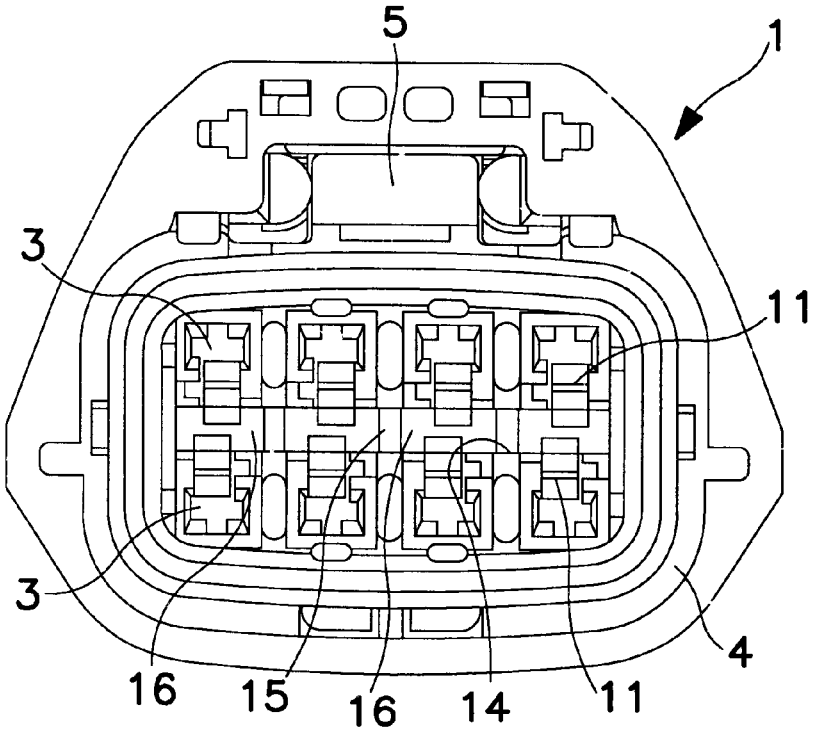
FIG. 3 is a front view of the female housing.

A female connector housing in accordance with the invention is identified by the numeral 1 in FIGS. 1–3. The female housing 1 preferably is made of a synthetic resin material.

The female housing 1 has a main body 2 which is formed with a plurality of cavities 3. Preferably four cavities 3 are provided in an upper stage and are aligned respectively with four cavities 3 in a lower stage. An outer tubular portion 4 having an open front end is formed substantially around a front half of the main body 2. An unillustrated mating male connector housing is fitted into the outer tubular portion 4. On the lateral, preferably upper surface of the main body 2 are provided a lock arm 5 for holding the male and female housings connected, a spring holder 6 assembled with a coil spring for detecting the connected state of the housings, etc. These members are described in detail below.

Four cavities 3 are arranged substantially side by side in each of the upper and lower stages as described above. In the mating side, preferably the front surface of each cavity 3 is formed a terminal insertion opening 10 through which a tab of a corresponding male terminal mounted in the mating male housing is insertable. In the bottom walls of the upper cavities 3 and the ceiling walls of the lower cavities 3 are formed locking portions 11. The locking portions 11 have a known construction and extend forwardly with the leading ends thereof hanging free. The respective locking portions 11 are provided with locking projections 12 that are fittable into locking holes 9 formed in female terminal fittings 8.

Although the upper and lower locking portions 11 are provided back to back, the upper locking portions 11 are located toward the right ends of the bottom walls of the corresponding cavities 3 and the lower locking portions 11 are located toward the left ends of the ceiling walls of the corresponding cavities 3 when viewed from front. In other words, the longitudinal axes of the corresponding locking portions in the upper and lower stages are transversely offset or displaced.

An insertion space 14 extends substantially over the entire width of the female housing 1 between the upper and lower stages of the cavities 3 in the front part of the main body 2. A back side of the insertion space 14 is partitioned by partition plates 15, so that e.g. four deformation permitting spaces 16 are defined between the pairs of the corresponding upper and lower locking portions 11. The leading sides or portions of the upper and lower locking portions 11 are elastically deformable into the corresponding deformation permitting spaces 16. In other words, the upper and lower locking portions 11 at least partially share the respective deformation permitting spaces 16.

Figure 4:
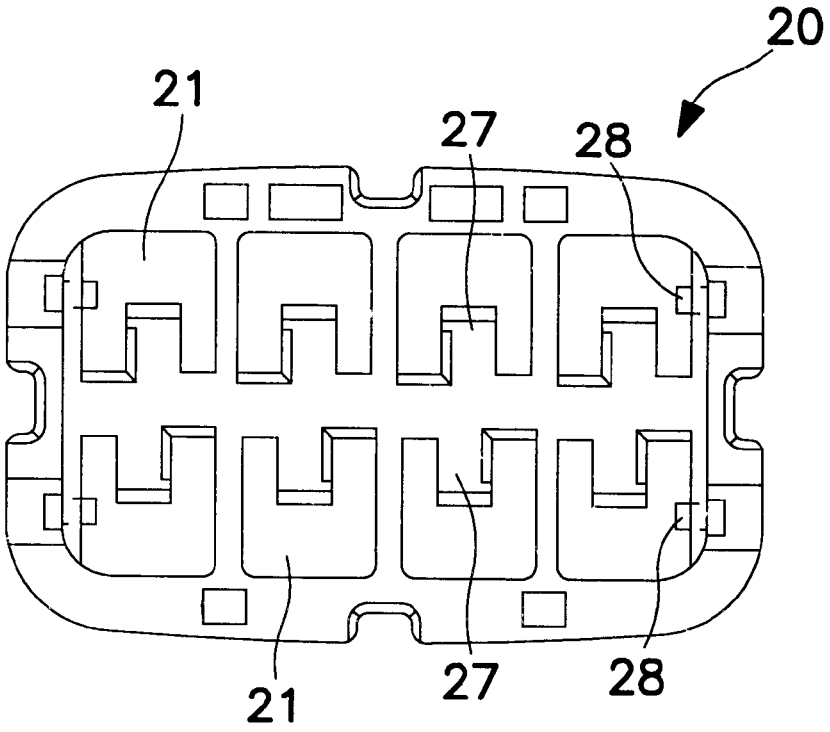
FIG. 4 is a rear view of the retainer.
Figure 5:
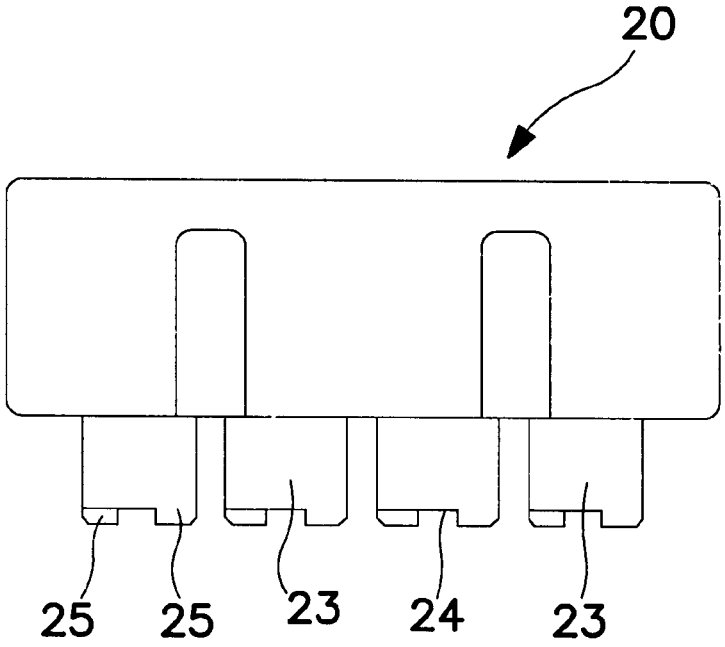
FIG. 5 is a plan view of the retainer.
Figure 6:
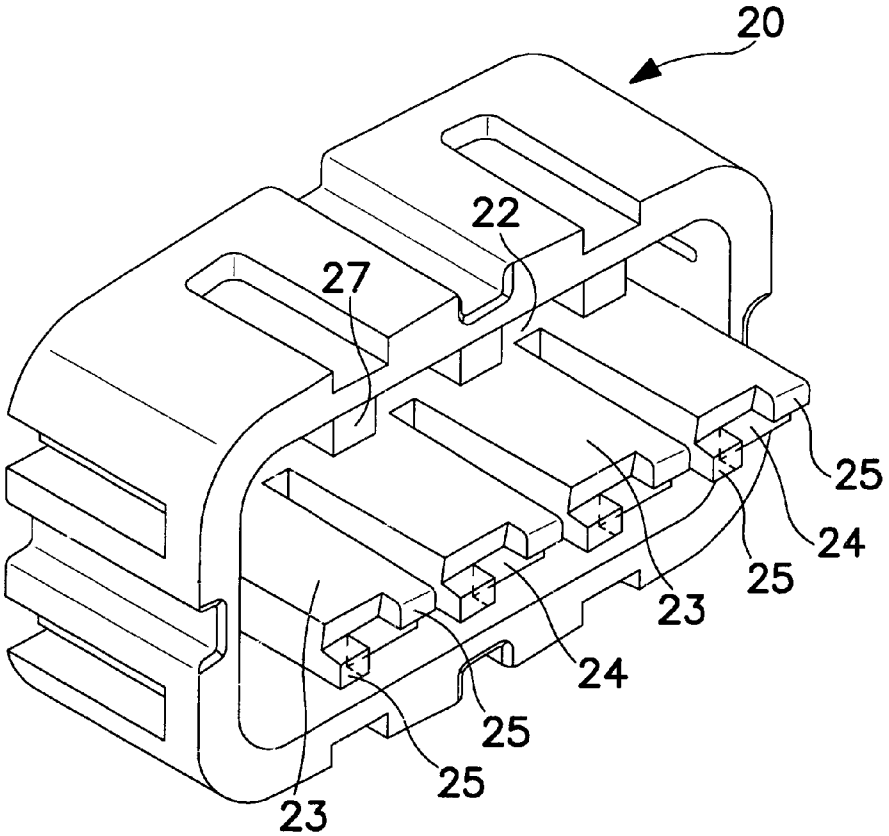
FIG. 6 is a perspective view of the retainer when viewed from front.

A retainer 20 for doubly locking the female terminal fittings 8 and detecting the insufficient insertion of the female terminal fittings 8 is mountable preferably at the front surface of the main body 2. This retainer 20 is preferably of so-called front type and is preferably in the form of a cap to be fitted on the front end of the main body 2 as shown in FIGS. 4 to 6.

In the rear surface (left surface in FIG. 1) of the retainer 20 with respect to an insertion direction, a total of e.g. eight windows are formed to have a lattice-like shape as a whole and substantially correspond to the respective cavities 3. A base plate 22 to be inserted into the above insertion space 14 is provided substantially in the middle of the retainer 20 with respect to vertical or height direction. Four detecting portions 23, at least a part of which is substantially closely insertable into the corresponding deformation permitting spaces 16, project from the leading end of the base plate 22, as shown in FIG. 5.

The substantially middle of an inserting end surface 24 of each detecting portion 23 with respect to the thickness or width direction thereof is retracted from the opposite ends, so that the inserting end surface 24 has a triangular cross section.

Excessive deformation preventing portions 25 are provided at the left and right ends of the inserting end surface 24 of each detecting portion 23 for restricting the elastic deformation of the corresponding locking portions 11 by coming into contact with leading ends 13 of the locking portions 11 The excessive deformation preventing portions 25 are formed substantially symmetrically with respect to vertical direction. More specifically, the excessive deformation preventing portions 25 are formed on lower slanted surfaces at the left ends of the inserting end surfaces 24 of the detecting portions 23 when viewed from front (front side in FIG. 6) so as to come into contact with the leading ends 13 (FIG. 7) of the upper locking portions 11. On the other hand, the excessive deformation preventing portions 25 are formed on upper slanted surfaces at the right ends of the inserting end surfaces 24 of the detecting portions 23 when viewed from front so as to come into contact with the leading ends 13 of the lower locking portions 11.

Wall forming portions 27 are formed on the upper and lower surfaces of the base plate 22 of the retainer 20. Each of the wall forming portions 27 forms the bottom or ceiling wall in front of the corresponding locking portion 11 when the retainer 20 is inserted substantially to its proper insertion position.

A pair of upper and lower elastic locking pieces 28 is formed on each of left and right side walls of the retainer 20. Further, as shown in FIG. 2, locking holes 29 are formed in the left and right side walls of the main body 2 of the female housing 1. The respective elastic locking pieces 28 are elastically fittable into the locking holes 29 when the retainer 20 is inserted substantially to its proper insertion position.

Figure 7:
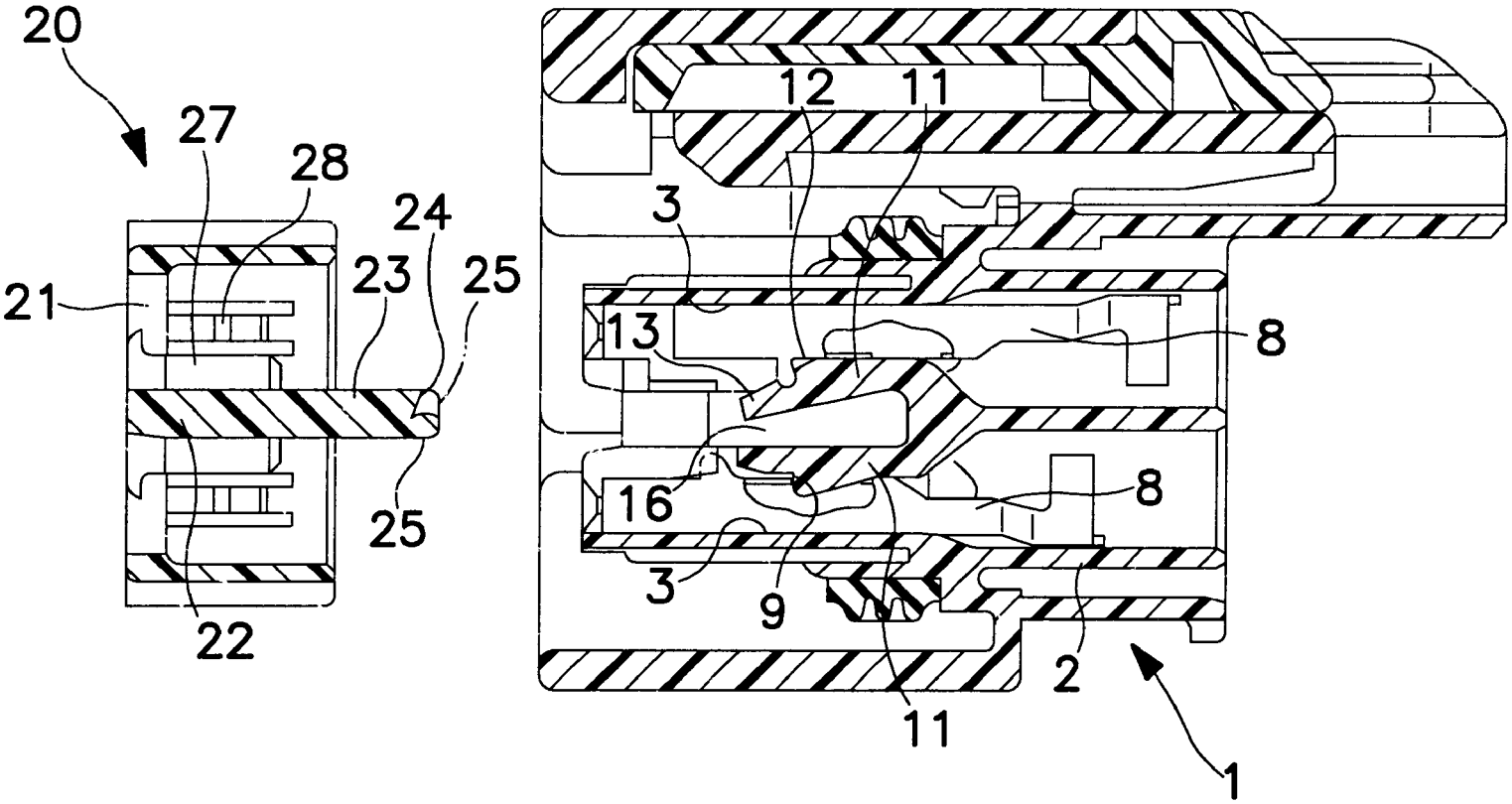
FIG. 7 is a vertical section showing an operation of inserting the female terminal fittings.

When the female terminal fitting 8 is inserted into the corresponding cavity 3 preferably from behind, it is pushed while elastically deforming the locking portion 11 to project into the deformation permitting space 16 shared by the pair of corresponding upper and lower locking portions 11 as shown in the upper stage of FIG. 7. When the female terminal fitting 8 is inserted to its proper insertion position, the locking portion 11 is restored preferably substantially to its original shape and at least partially fitted into the locking hole 9 as shown in the lower stage of FIG. 7. In this way, the female terminal fitting 8 is locked so as not to be withdrawn in a withdrawal direction, preferably the backward direction.

Figure 8:
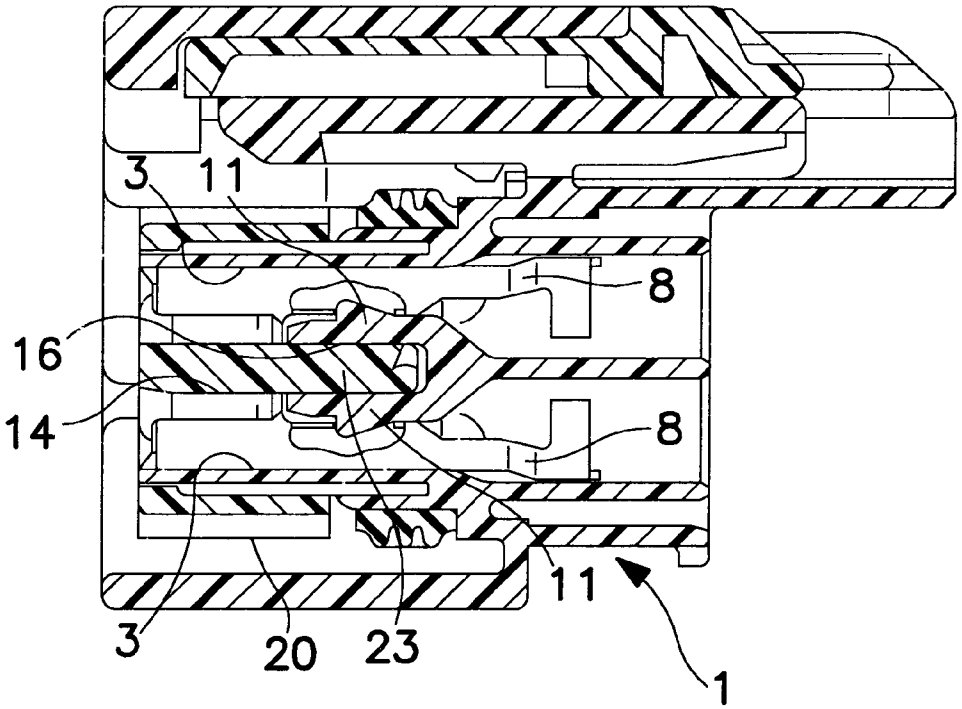
FIG. 8 is a vertical section showing a state where the retainer is in its proper insertion position.

When the insertion of all female terminal fittings 8 is completed, the retainer 20 is inserted so as to be put on the front part of the main body 2 of the female housing 1. When the retainer 20 is inserted to a specified position, the retainer 20 is so mounted as not to disengage by the engagement of the elastic locking pieces 28 and the locking holes 29 of the main body 2. At substantially this time, at least a part of the respective detecting portions 23 are substantially closely inserted into the corresponding deformation permitting spaces 16 as shown in FIG. 8. Since the elastic deformation of the locking portions 11 is restricted in this way, the female terminal fittings 8 are doubly locked.

Figure 9:
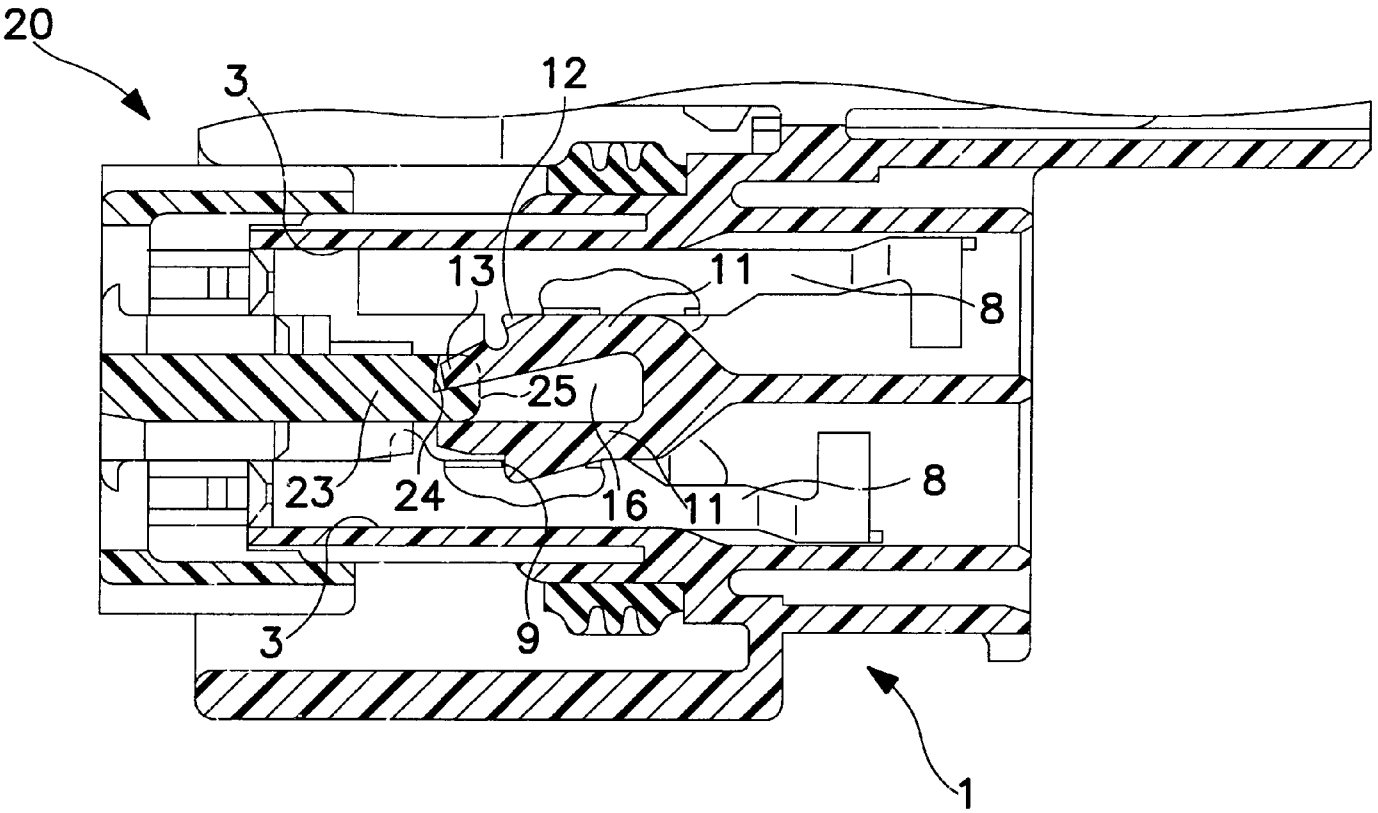
FIG. 9 is a partial enlarged vertical section showing a state where the insufficient insertion of the female terminal fitting is detected.
Figure 10:
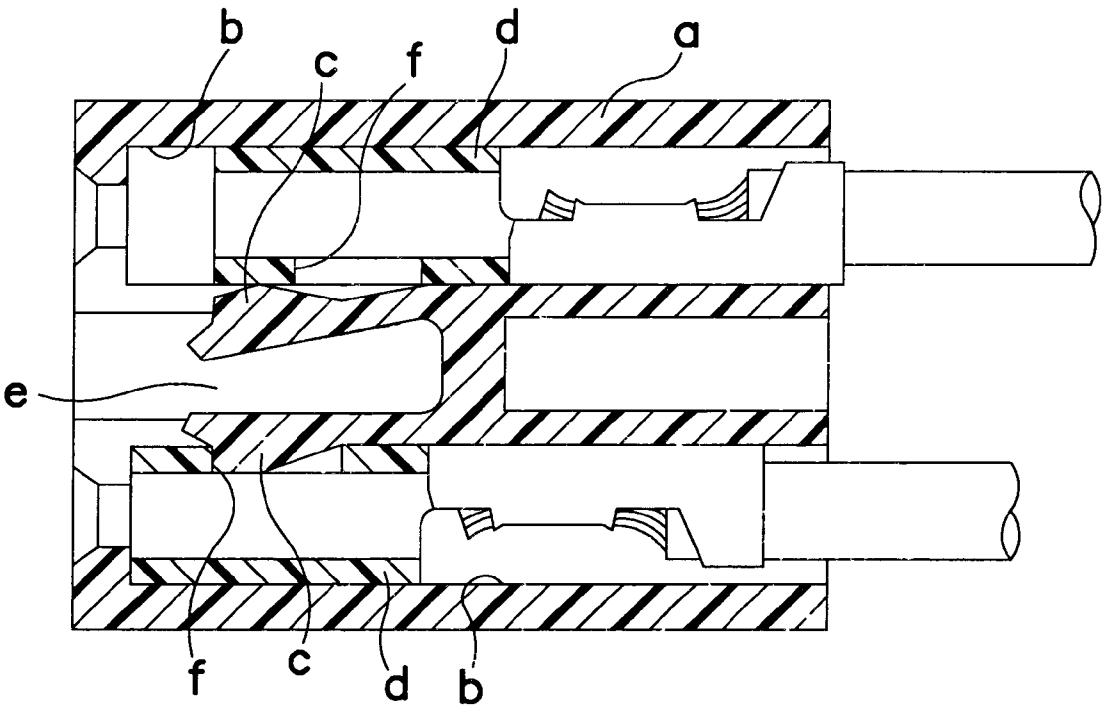
FIG. 10 PRIOR ART
FIG. 10 is a vertical section of a prior art connector.
Figure 10:
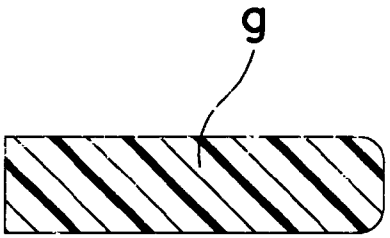
FIG. 10 PRIOR ART

On the other hand, the female terminal fitting 8 may be left insufficiently inserted without being inserted to its proper insertion position as shown in the upper stage of FIG. 7. In such a case, the locking portion 11 is elastically deformed and the leading end 13 thereof projects into the deformation permitting space 16. If the retainer 20 is inserted in this state, the inserting end surface 24 of the corresponding detecting portion 23 comes into contact with the projecting locking portion 11 as shown in FIG. 9.

Here, if the retainer 20 is forcibly inserted, it may be further inserted while further deflecting the locking portion 11. However, even if the locking portion 11 tries to be deflected, the leading end 13 thereof is brought into contact with the excessive deformation preventing portion 25 (lower side) provided on the inserting end surface 24 of the detecting portion 23 (FIG. 9). This prevents the locking portion 11 from being excessively deformed and stops any further insertion of the retainer 20.

Also in the case that the female terminal fitting 8 is left insufficiently inserted in the lower stage, the corresponding locking portion 11 is brought into contact with the upper side excessive deformation preventing portion 25 in a similar manner, which prevents it from being excessively elastically deformed.

If the presence of the female terminal fitting 8 left insufficiently inserted is detected by the retainer 20 being unable to be inserted to its proper insertion position as described above, the corresponding female terminal fitting 8 may be pushed further to its proper insertion position.

As described above, the excessive elastic deformation of the locking portions 11 is restricted by the excessive deformation preventing portions 25 provided on the retainer 20 according to this embodiment. This prevents the locking portions 11 from being damaged or broken. Further, since the excessive deformation preventing portions 25 can also restrict any further insertion of the retainer 20, the insufficient insertion of the female terminal fittings 8 can be detected more accurately.

The female housing 1 according to this embodiment is designed to reduce its height by arranging the upper and lower locking portions 11 back to back to share the deformation permitting spaces 16. Here, if the pairs of upper and lower locking portions 11 are formed in the middle of the cavities 3 with respect to the widthwise direction thereof, i.e. the longitudinal axes of the upper and lower locking portions are aligned substantially with respect to the transverse direction, the excessive deformation preventing portions 25 as above cannot be formed on the detecting portions 23 of the retainer 20.

Since the corresponding upper and lower locking portions 11 are arranged such that the longitudinal axes thereof are transversely offset to each other in this embodiment, the excessive deformation preventing portions 25 which can interact with the upper and lower locking portions 11 can be formed at the left and right ends of the detecting portions 23.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

The present invention is also applicable to connectors of the type in which deformation permitting portions are provided for individual locking portions without being shared.

The invention is not only applicable to female housings as shown in the foregoing embodiment, but also similarly applicable to male housings.

What is claimed is:

1. A connector, comprising:

a housing having at least first and second cavities into which first and second terminal fittings are insertable, first and second elastically deformable locking portions defining peripheral parts of the respective first and second cavities and being separated from one another by a deformation permitting space, each of said first and second locking portions permitting insertion of the respective first and second terminal fittings by being elastically deformed into the deformation permitting space and being restored to a position not projecting into the deformation permitting space when the terminal fitting is inserted to a proper insertion position for locking the respective terminal fitting in the respective cavity, the elastically deformable locking portions being partly offset from one another in directions transverse to a direction of deformation of the locking portions; and a retainer having a detecting portion with an inserting end surface insertable into the deformation permitting space when the locking portions are not in the deformation permitting space, the detecting portion having a first side facing the first cavity and a second side facing the second cavity, the detecting portion contacting either of the locking portions that has been elastically deformed into the deformation permitting space by one of said terminal fittings that has been insufficiently inserted, thereby enabling a detection of insufficient insertion of either one of the terminal fittings, wherein the detecting portion comprises first and second spaced apart excessive deformation preventing portions projecting from the inserting end surface, the first excessive deformation preventing portion being aligned with the first locking portion but not with the second locking portion and being aligned with the second side of the detecting portion but being offset from the first side thereof, the second excessive deformation preventing portion being aligned with the second locking portion but not with the first locking portion and being aligned with the first side of the detecting portion but offset from the second side thereof, the first and second excessive deformation preventing portions restricting an excessive elastic deformation of the respective first and second locking portions by coming into contact with a contact part of the respective locking portion.

2. A connector according to claim 1, wherein the housing has a rear end into which said terminal fittings are inserted and an opposed front end, the deformation permitting space being open to the front end of the housing, the retainer being mountable over the front end of the housing such that the detecting portion projects rearwardly and into the deformation permitting space.

3. A connector according to claim 1, wherein the contact part of each said locking portion is on a side of the locking portion facing away from the respective cavity.

4. A connector according to claim 1, wherein the inserting end surface of the detecting portion intersects the excessive deformation preventing portions at an acute angle for securely engaging the respective locking portion and preventing excessive deformation of the respective locking portion.

5. A connector according to claim 1, wherein the first and second cavities are aligned with one another in directions transverse to the direction of deformation of the locking portion.

6. A connector comprising:

a housing having at least first and second cavities, first and second locks separated from one another by a deformation permitting space, the first and second locks each being independently deformable from an unbiased condition where a portion of the lock projects into the respective cavity to a biased condition where the respective lock projects partly into the deformation permitting space, the first and second locks being partly laterally offset from one another in directions transverse to directions of elastic deformability of the respective locks;

first and second terminal fittings configured for insertion into the respective cavities, and further being configured for generating deformation of the respective locks into the biased condition during said insertion and permitting return of the locks to the unbiased condition after complete insertion;

a retainer mountable to the housing and having a detector with an inserting end surface configured for insertion into the deformation permitting space when said locks are in the unbiased condition, the detector having a first side facing the first cavity and a second side facing the second cavity, the detector further being dimensioned to contact either of said locks that is in the respective biased condition; and first and second spaced apart excessive deformation preventing portions projecting from the inserting end surface on the detector, the first excessive deformation preventing portion being aligned with the first lock and being offset laterally from the second lock, the first excessive deformation preventing portion further being offset from the first side of the detector sufficiently for insertion between the locks when the first lock is in the biased condition, such that portions of the inserting end surface aligned with the first excessive deformation preventing portion engage the first lock in the biased condition, the second excessive deformation preventing portion being aligned with the second lock and being offset laterally from the first lock, the second excessive deformation preventing portion being offset from the second side of the detector sufficiently for insertion between the locks when the second lock is in the biased condition, such that portions of the inserting end surface aligned with the second excessive deformation preventing portion engage the second lock when the second lock is in the biased condition.

7. A connector according to claim 6, wherein the housing has opposed front and rear ends, the terminal fittings being insertable into the rear end of the housing, the deformation permitting space being open to the front end of the housing, the retainer being mountable to the front end of the housing, and the detector projecting toward the rear end of the housing and into the deformation permitting space, the excessive deformation preventing portions projecting from an end of the detector closest to the rear end of the housing.

8. A connector according to claim 6, wherein the first excessive deformation preventing portion has a surface facing the first lock that is aligned to the inserting end surface of the detector at an acute angle, and wherein the second excessive deformation preventing portion has a surface facing the second lock that is aligned to the inserting end surface of the detector at an acute angle.

9. A connector according to claim 6, wherein said first and second locks are formed with projections that project into the respective first and second cavities, the projections being engageable by the respective first and second terminal fittings during insertion of the terminal fittings for deflecting the locks into the deformation permitting space, the projections being configured to engage the respective first and second terminal fittings after complete insertion for locking the terminal fittings in the respective first and second cavities.

10. A connector, comprising:

at least one pair of cavities, each said cavity being configured to accommodate a terminal, each said pair of cavities having a pair of locks disposed back-to-back with a common deformation permitting space therebetween, said locks being elastically deformable about parallel deformation axes to project into the deformation permitting space during insertion of the terminals into the respective cavities, and being restored to a position substantially not projecting into the deformation permitting space when the respective terminal is inserted to a proper insertion position, the locks in said pair being partly offset from each other in directions parallel to the deformation axes; and a retainer having a detector with an inserting end surface which is insertable into the common deformation permitting space, the detector being configured to contact any said lock that is elastically deformed into the deformation permitting space, thereby enabling detection of insufficient insertion of at least one said terminal, the detector having first and second opposite sides facing the respective cavities in the pair, first and second transversely offset excessive deformation preventing portions projecting from the inserting end surface, such that the first excessive deformation preventing portion is aligned with the first lock but offset transversely from the second lock and such that the second deformation preventing portion is aligned with the second lock but is offset transversely from the first lock, the excessive deformation preventing portions being configured such that, before the detector contacts either of said locks that are elastically deformed into the deformation permitting space, the excessive deformation preventing portions are moved between the locks and into a position for preventing excessive deformation of the respective locks.

11. A connector according to claim 10, wherein each said excessive deformation preventing portion has a surface that meets the inserting end surface of the detector at an acute angle.

* * * * *